US006304161B1

(12) United States Patent
Schebitz et al.

(10) Patent No.: US 6,304,161 B1
(45) Date of Patent: Oct. 16, 2001

(54) ELECTROMAGNETIC ACTUATOR, PARTICULARLY FOR DRIVING AN ENGINE VALVE

(75) Inventors: Michael Schebitz, Eschweiler; Ernst-Siegfried Hartmann, Overath; Jurgen Wahnschaffe, Bergisch Gladbach; Hans Willi Goebel, Köln; Holger Lange, Aachen, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/507,935

(22) Filed: Feb. 22, 2000

Related U.S. Application Data

(63) Continuation of application No. 09/428,461, filed on Oct. 28, 1999, now abandoned.

(30) Foreign Application Priority Data

Oct. 28, 1998 (DE) ..... 198 49 690
May 19, 1999 (DE) ..... 199 22 972

(51) Int. Cl.[7] ..... H01F 3/00
(52) U.S. Cl. ..... 335/255; 335/258; 251/129.01
(58) Field of Search ..... 123/90.11, 90.1; 251/129.01, 129.02, 129.05, 129.1, 129.15, 129.16, 129.17, 129.18; 335/256, 257, 258, 266, 268, 251, 255

(56) References Cited

U.S. PATENT DOCUMENTS 3,635,240 * 1/1972 Vischulis et al. ..... 137/495
4,674,540 * 6/1987 Takei et al. ..... 137/625.65
5,720,468 * 2/1998 Morinigo ..... 251/129.1
5,730,091 * 3/1998 Diehl et al. ..... 123/90.11
6,101,992 * 8/2000 Pischinger et al. ..... 123/90.11

* cited by examiner

*Primary Examiner*—Lincoln Donovan
*Assistant Examiner*—Tuyen Nguyen
(74) *Attorney, Agent, or Firm*—Venable; Gabor J. Kelemen

(57) ABSTRACT

An electromagnetic actuator for operating a driven component includes first and second electromagnets having respective first and second pole faces oriented toward one another and defining a space therebetween; an armature disposed between the electromagnets and movable back and forth between the first and second pole faces in a direction of motion; a driving component attached to the armature for moving therewith as a unitary structure; and a resetting spring unit attached solely to the driving component or the driven component and exerting forces opposing movements of the armature caused by electromagnetic forces generated by the electromagnets. The resetting spring unit is in a relaxed state when the armature is in a mid position between the first and second pole faces and is in an armed state upon movement of the armature from the mid position in either direction. A mechanism connects the driving component with the driven component for effecting a transmission of moving forces from the driving component to the driven component to cause displacements of the driven component as a function of displacements of the armature and the driving component.

17 Claims, 6 Drawing Sheets

ELECTROMAGNETIC ACTUATOR, PARTICULARLY FOR DRIVING AN ENGINE VALVE

CROSS REFERENCE TO RELATED APPLICATION

This application is a continuation of pending Application Ser. No. 09/428,461 filed Oct. 28, 1999 now abandoned.

This application claims the priority of German Application Nos. 198 49 690.7 filed Oct. 28, 1998 and 199 22 972.4 filed May 19, 1999, which are incorporated herein by reference.

BACKGROUND OF THE INVENTION

German Offenlegungsschrift (application published without examination) No. 33 07 070 discloses an electromagnetic actuator for operating a component, particularly a cylinder valve of an internal-combustion engine. The actuator has an armature which may be reciprocated back and forth between the pole faces of two electromagnets by magnetic forces against oppositely oriented resetting springs. The actuator system is designed in such a manner that in case the electromagnets are in a de-energized state, the armature, urged by the oppositely acting resetting springs, assumes a position between the two pole faces. In such a known system it is assumed that the two resetting springs are identical in their geometry, especially as concerns their length in a relaxed state and their spring curve. The purpose of such an identical arrangement is to ensure that essentially identical magnetic forces are needed for attracting and holding the armature at the respective pole faces and that essentially identical spring forces are present first, for accelerating the armature when its leaves the respective pole face and second, for braking the armature when it approaches the respective opposite pole face. Such springs are conventionally compression coil springs. In a mass manufacture of such coil springs, however, it is not feasible to make identical springs in sufficient quantities at an acceptable cost.

SUMMARY OF THE INVENTION

It is an object of the invention to provide an improved actuator of the above-outlined type which permits greater tolerances for the geometry and characteristics of the resetting springs.

This object and others to become apparent as the specification progresses, are accomplished by the invention, according to which, briefly stated, the electromagnetic actuator for operating a driven component includes first and second electromagnets having respective first and second pole faces oriented toward one another and defining a space therebetween; an armature disposed between the electromagnets and movable back and forth between the first and second pole faces in a direction of motion; a driving component attached to the armature for moving therewith as a unitary structure; and a resetting spring unit attached solely to the driving component or to the driven component and exerting forces opposing movements of the armature caused by electromagnetic forces generated by the electromagnets. The resetting spring unit is in a relaxed state when the armature is in a mid position between the first and second pole faces and is in an armed (stressed) state upon movement of the armature from the mid position in either direction. A mechanism connects the driving component with the driven component for effecting a transmission of moving forces from the driving component to the driven component to cause displacements of the driven component as a function of displacements of the armature and the driving component.

An actuator according to the invention as summarized above has the advantage that the resetting spring arrangement may be composed of a single spring, whereby a reduction of the structural height is feasible. The spring arrangement is so designed that when the armature moves out of its mid position between the two pole faces in either direction, the spring arrangement is armed to exert a resetting force on the armature against the magnetic force. The coupling device provides for the required form-fit between the driving component (such as a guide bar affixed to the armature) and the driven component (such as an engine valve of an internal combustion engine). In this manner the armature and the driven component are reciprocated as a unit. Further, by the slack adjusting means incorporated in the coupling device a reliable end position of the armature and the driven component are ensured.

Thus, if the electromagnetic actuator is used for operating an engine valve, in the de-energized state of the electromagnets the engine valve is maintained by the resetting spring arrangement in a halfway open stroke so that upon energization of one of the electromagnets, the engine valve is moved into the closed position and upon energizing the other electromagnet, the engine valve is moved into the fully open position. To counteract external interferences which disturb the operation of the engine valves, such as fluctuating temperatures which result in alternating lengths of the driving and the driven components, and also to compensate for component wear which may likewise lead to length changes, the coupling element provides for an automatic length compensation. In particular, in case the actuator is used for driving an engine valve, it is of importance that in the closed position of the engine valve the valve head lies tightly against the valve seat and at the same time the armature engages the pole face of the closing magnet. Only these simultaneous occurrences ensure that the closed position of the valve may be maintained with a minimum holding current and thus with a small energy input. Upon an increase of the operating temperature, a lengthening of the driving component (that is, the guide bar affixed to the armature) and the driven component (that is, the valve stem of the engine valve) occurs. Consequently, in case of a rigid coupling between the two components the valve head would no longer engage its valve seat when the armature lies against the pole face of the closing magnet. Likewise, upon a shortening of the overall length due to a cold engine condition, the armature would not engage the respective pole face when the valve is already seated. Therefore, the coupling device has to be designed such that an overall length change of the two components (lengthening or contracting) is compensated for. Thus, in the cold condition when the total length of the components is reduced, the armature may arrive into contact with the pole face of the closing magnet when the valve head has reached the valve seat, and likewise, in case of a lengthening due to a heat-up of the valve seat, the valve head may be firmly seated when the armature has reached the pole face of the closing magnet. In this manner an automatic compensation is achieved so that in the closed position the valve head as well as the armature reliably assume at all times their contacting position with the valve seat and the pole face of the closing magnet, respectively.

In accordance with an advantageous feature of the invention, the spring assembly is connected with the driving component by an adjusting mechanism for adjusting the mid position of the armature between the two pole faces of the electromagnet. Such a mechanism permits the mass manufacture of the springs which have essentially the same spring curve but which, because of manufacturing tolerances, may have different lengths. With the aid of the adjusting mechanism it is thus possible to compensate for various lengths so that the mid position of the armature between the two pole faces of the electromagnets is ensured when the springs are in a relaxed state and the electromagnets are in their de-energized condition.

According to a further advantageous feature of the actuator of the invention, the spring assembly is formed by at least one wound spring. Such wound springs may be mass manufactured in a great variety of configurations.

In accordance with a further advantageous embodiment of the invention, the spring is wound as a coil spring and may be loaded by either tensioning or compressing forces. In such a system the spring may be connected in the housing of the actuator with the valve in a "classical" manner, that is, the coil spring surrounds the valve stem and is affixed at one end to the cylinder head and at the other end to a spring seat disk secured to the valve stem. The spring is dimensioned in its length such that in the relaxed state the valve is maintained in a half-open state. A construction in which the valve stem is connected with the driving component of the actuator via the coupling device, may likewise be moved in the desired manner into the closed and open positions while the spring is alternatingly armed by tension and compression.

In case of a spring unit integrated in the actuator, according to an advantageous feature of the invention, the wound spring is secured to the driving component at one spring end and to the actuator housing at the other spring end. Expediently, the securement to the housing is effected with the intermediary of the mechanism for adjusting the mid position of the armature. The coil spring may be disposed in the axial prolongation of the driving component at its end oriented away from the driven component and/or may coaxially surround the driving or the driven component.

According to a further advantageous feature of the invention, the coil spring is rigidly secured to the driving component at one spring end and is movably mounted on the housing at the other spring end such that the spring is rotatable about the axis of the driving component. It is an advantage of such an arrangement that the rotary motions of the armature in response to the expansion or compression of the coil spring are reduced to a minimum because the armature and the driven component, such as an engine valve, may freely rotate relative to the housing of the actuator. The rotatable securement of the coil spring to the housing may be coupled with the mechanism for adjusting the mid position of the armature. It is also feasible to provide the adjusting mechanism at the connection between the coil spring and the driving component.

In accordance with a further advantageous feature of the invention, the two wound springs constituting coil springs have oppositely oriented windings and are positioned parallel side-by-side and flank the driving component such that the spring axes extend parallel to the axis of the driving component. By virtue of such an arrangement a short-length construction is feasible while the driven component may execute large strokes.

In accordance with a further advantageous feature of the invention, the spring assembly has at least two springs formed as rotary springs. Such springs, within the meaning of the present description, are coil springs in which at least one winding has an extension (leg) which projects approximately tangentially to the spring body and which is oriented perpendicularly to the spring axis. The spring leg is exposed to forces which are transverse to the spring axis. In response to such forces the spring windings contract or expand about the spring axis (winding axis). In the arrangement according to the invention the two rotary springs have oppositely oriented windings and are each secured at one end to the actuator housing and at the other end to the driving component. Such rotary springs again permit designs in which a relatively large stroke may be achieved while the spring arrangement is of short-length construction parallel to the stroke direction. The rotary springs are disposed such that their axes are oriented perpendicularly to the axis of the driving component. It is further expedient to arrange the rotary springs parallel to one another and at opposite sides of the driving component.

In accordance with a further advantageous feature of the invention two spring elements are provided, wherein each spring element is composed of two oppositely wound rotary springs. The two spring elements are arranged parallel to one another on either side of the driving component. The rotary springs combined into a spring element are of identical dimensions and are connected to the driving component in the transitional zone where the winding direction changes and which is located in the middle of the spring element. By virtue of such an arrangement, during operation unavoidable changes of the spring length parallel to the winding axis are equalized. A parallel arrangement of two spring elements ensures that practically no transverse forces are exerted on the driving component and, accordingly, the frictional forces in the guidance of the driving component are reduced to a minimum.

In accordance with a further advantageous feature of the invention the spring unit is formed by a leaf spring exposed to bending. Such a leaf spring, which may also be constituted by a diaphragm clamped along its periphery, results in an extremely small structural height of the entire actuator. The leaf spring may be clamped at one end or, expediently, at both ends. Expediently, the connection between the leaf spring and the driving component is effected in the middle between the two clamping locations of the spring. In this embodiment too, the connection between the driving component and the leaf spring is effected with the interposition of an adjusting mechanism for adjusting the mid position of the armature for the relaxed state of the spring. The leaf spring may also be constituted by a simple bar or a bending/torsion spring. The latter may be a diaphragm composed of radial spring arms extending from a central hub attached to the driving component. The outer ends of the spring arms are clamped such that the arms are twisted.

DESCRIPTION OF THE PREFERRED EMBODIMENTS

Figure 1:
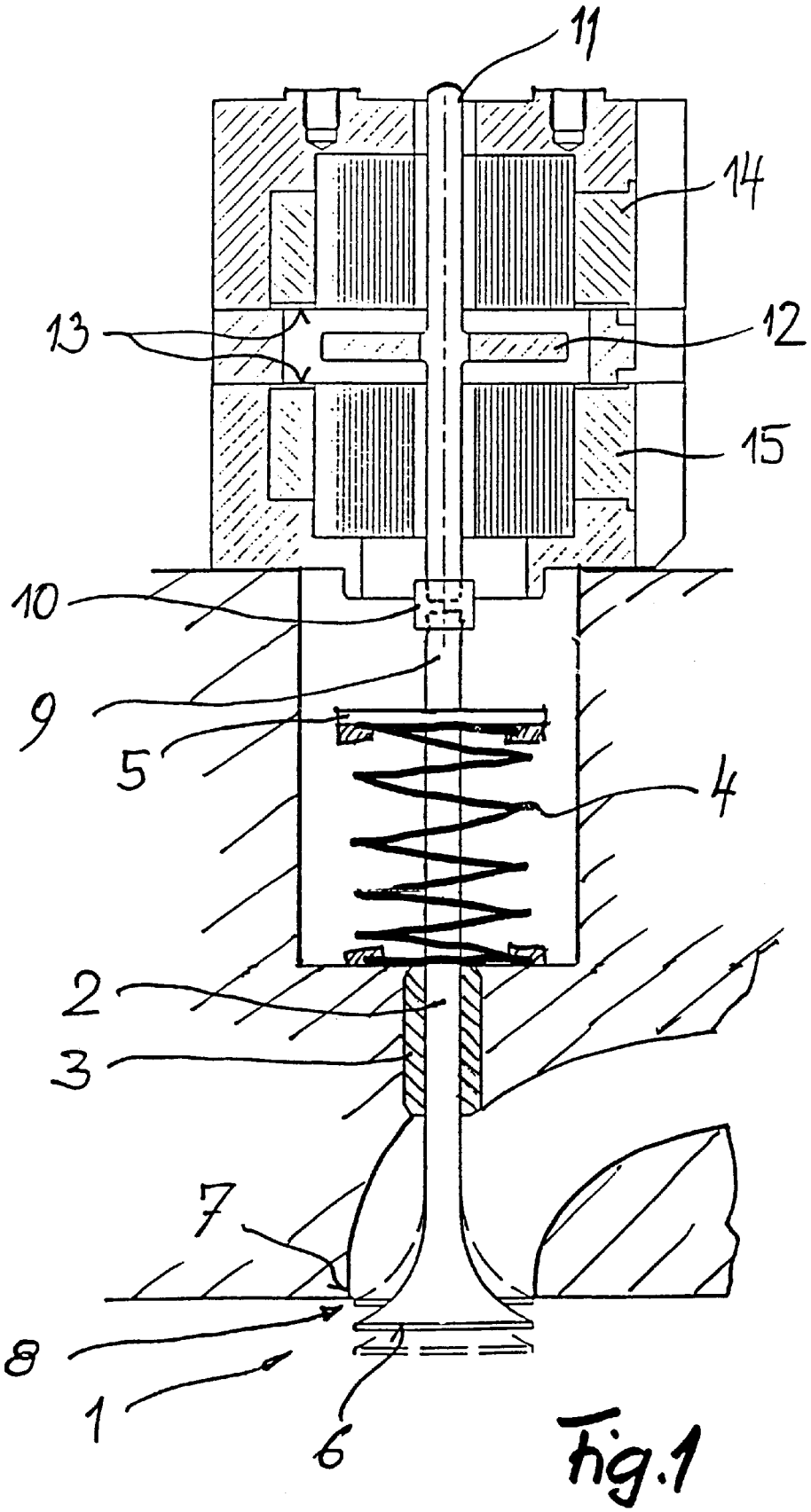
FIG. 1 is a schematic axial view, partially in section, of the basic arrangement of an electromagnetic actuator for driving an engine valve, showing a preferred embodiment of the invention.

FIG. 1 is a vertical section taken through the cylinder head of an internal-combustion engine in the region of an engine valve 1 having a valve stem 2. The valve stem 2 is guided in a sealed manner in a guide 3 of the cylinder head. In the region of its free end the valve stem 2 is connected with a wound spring unit 4 forming a coil spring. The connection is configured in such a manner that one end of the spring unit 4 is immovably affixed to the cylinder block and its other end is immovably affixed to a spring seat disk 5 firmly attached to the valve stem 2. In this arrangement the spring unit 4 may be exposed to either pulling or compressing forces.

The length of the spring unit 4 is so dimensioned that the valve head 6 of the engine valve 1 is, in the relaxed state of the spring unit 4, in a half-open position. The gas passage opening 8 bounded by the valve seat 7 is thus one-half open. If the spring unit 4 is exposed to tension, the valve head 6 is pulled into contact with the valve seat 7 and thus the gas flow passage 8 is closed. If, on the other hand, the spring unit 4 is compressed, the valve head 6 is pushed into its fully open position (full stroke) and thus the gas flow passage opening 8 is fully open.

The free end 9 of the valve stem 2 of the engine valve 1 (driven component) is connected via a coupling device 10 with a driving component 11 configured as a guide bar which is firmly affixed to an armature 12.

The armature 12 may be reciprocated between two spaced pole faces 13 which are oriented towards one another and which form part of two respective electromagnets 14 and 15. The dimensions are such that in case of a relaxed state of the spring unit 4, the armature 12 is in a mid position between the two pole faces 13. If the electromagnet 14 serving as a closing magnet is energized, the armature 12 is attracted and arrives into engagement with the pole face 13 of the closing magnet 14. As a result, the engine valve 1 is closed.

If the closing magnet 14 is de-energized and the electromagnet 15 serving as the opening magnet is energized, the armature 12 is released from the pole face 13 of the closing magnet 14 and is brought into contact with the pole face 13 of the opening magnet 15, as a result of which the engine valve 1 is fully opened. In both directions of motion the displacement of the armature 12 is effected by the respective magnetic force against the return force of the spring unit 4.

The coupling device 10 is so designed that it provides for a form-fitting connection between the guide bar (driving component) 11 and the valve stem 2 of the engine valve (driven component) 1. Consequently, the armature 12 and the valve head 6 are movable back and forth as a unit. The coupling device 10, however, slightly yields in the axial direction so that length changes (elongations or retractions) of the valve stem 2 are compensated for in such a manner that when the armature 12 engages the pole face 13 of the closing magnet 14, the valve head 6 firmly engages the valve seat 7. The compensation of such length changes may be effected by elastic means. Such means may be spring elastic/mechanical devices or hydraulic or hydraulic/pneumatic resilient arrangements.

Figure 2:
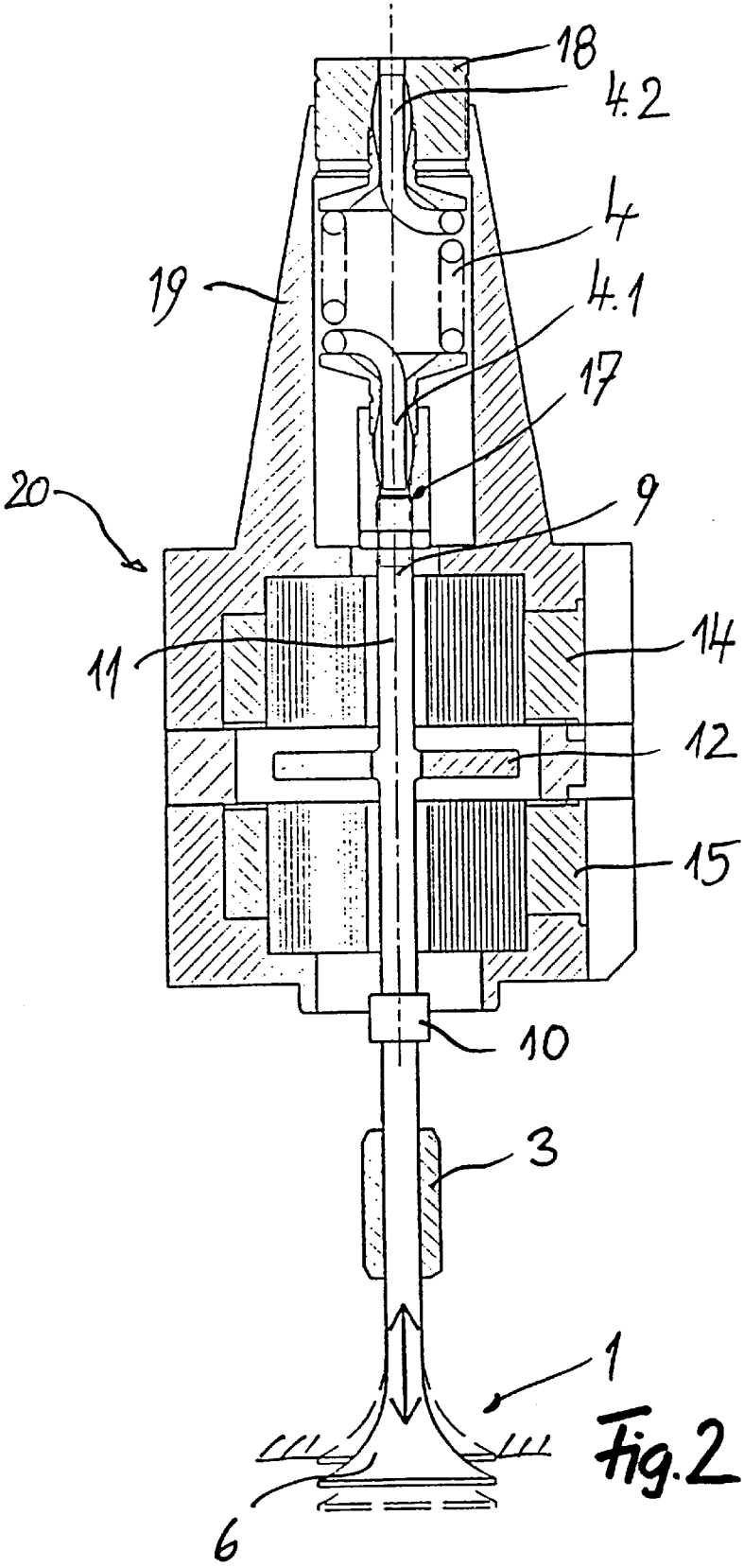
FIG. 2 is a view similar to FIG. 1 showing a spring unit disposed in an actuator housing according to another preferred embodiment of the invention.

In the embodiment according to FIG. 2, the spring unit 4, similarly to the earlier described embodiment shown in FIG. 1, is constituted by a coil spring having terminal legs 4.1 and 4.2 aligned with the central axis of the spring. The terminal 4.1 is affixed to the free end 9 of the driving component 11 by a clamping element 17. The terminal 4.2 is attached to an adjusting nut 18 which serves for setting the mid position of the armature 12 between the two pole faces 13. The adjusting nut 18 is threadedly received in a projection 19 of the actuator housing 20 and positions the spring unit 4 as an axial continuation of the driving component 11.

Figure 3:
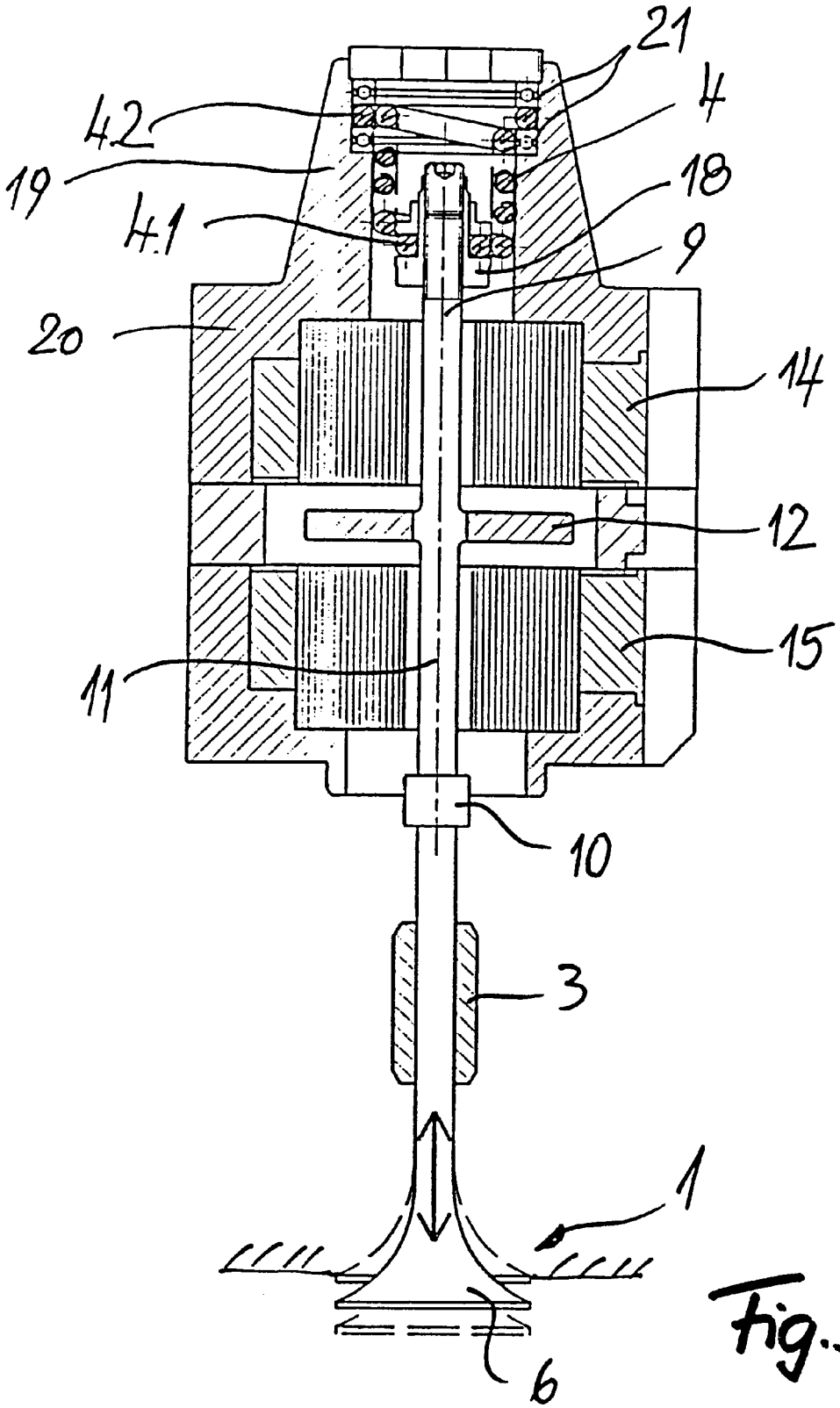
FIG. 3 is a variant of the embodiment shown in FIG. 2.

In the embodiment illustrated in FIG. 3, the spring unit 4 is formed by a coil open at both ends and coaxially surrounds the free end 9 of the driving component 11. In this embodiment the last spring turn is wound circularly to form respective, clampable terminals 4.1 and 4.2. The terminal 4.1 is connected with the driving component 11 with the intermediary of an adjusting nut 18 serving as an adjusting mechanism for setting the mid position of the armature 12. The terminal 4.2 is rotatably attached to the projection 19 of the housing 20 so that it may turn about the longitudinal central axis of the driving component 11. By virtue of such an arrangement, upon tensioning or compressing the spring unit 4, the torques produced between the driving component 11 and the housing 20 do not affect the armature 12, so that its rotary motions are reduced to a minimum.

Figure 4:
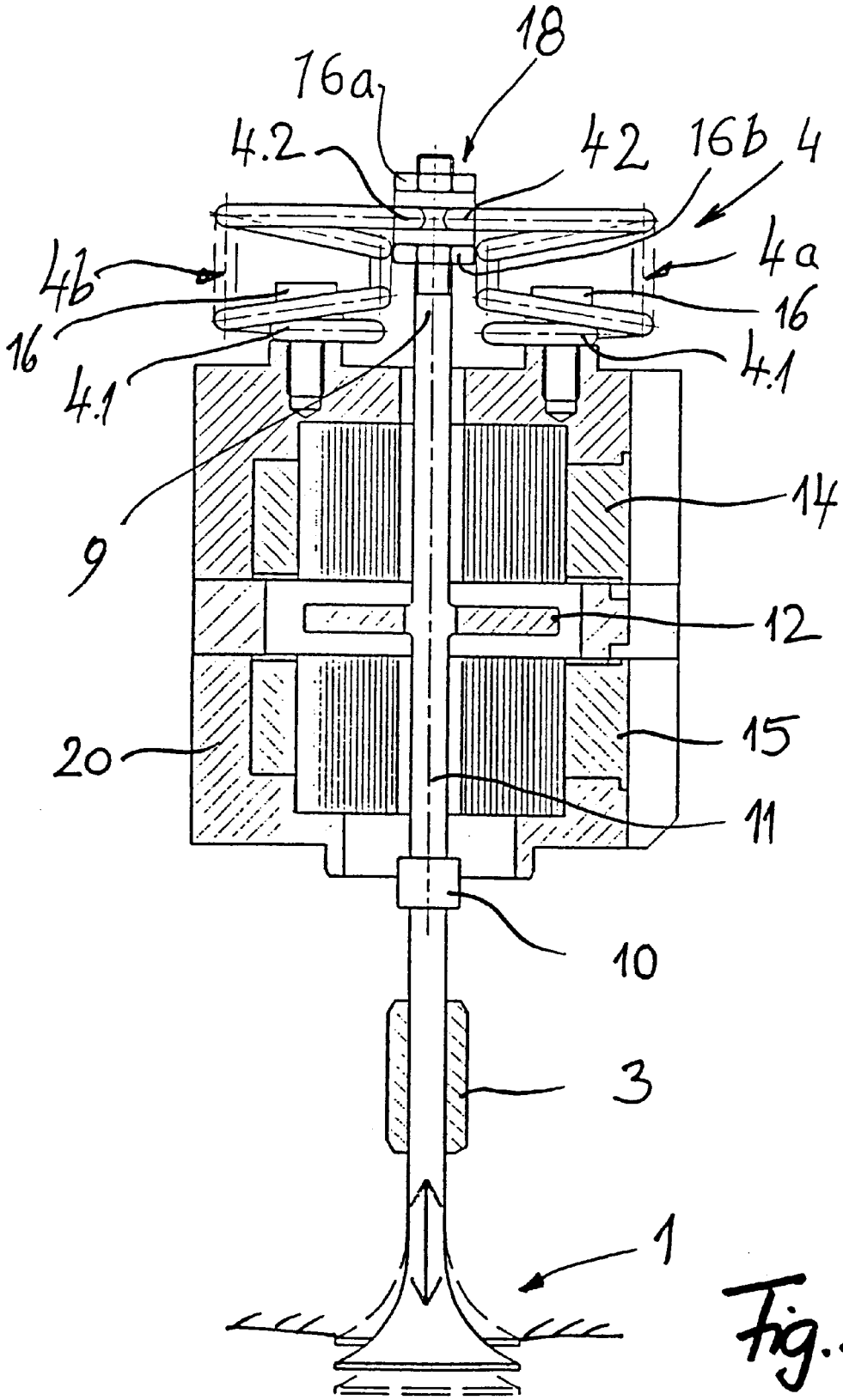
FIG. 4 is an axial elevational view, partially in section, of a further preferred embodiment including two parallel-arranged compression coil springs.

FIG. 4 shows a variant of the two previously-described embodiments. In the embodiment according to FIG. 4 the spring unit 4 is composed of two coil springs 4*a* and 4*b*, each having opposite, clampable terminals 4.1 and 4.2. The terminals 4.1 of the two springs 4*a* and 4*b* are tightened to the actuator housing 20 by screws 16, while the spring terminals 4.2 are tightened to the end 9 of the driving component 11 by an adjusting mechanism 18 comprising nuts 16*a*, 16*b*. The windings of the springs 4*a* and 4*b* are oppositely oriented. By means of the nuts 16*a*, 16*b* of the adjusting mechanism 18 the mid position of the armature 12 may be set which it assumes when the spring unit 4 is in a relaxed condition and the electromagnets 15, 15 are in a de-energized state.

Figure 5:
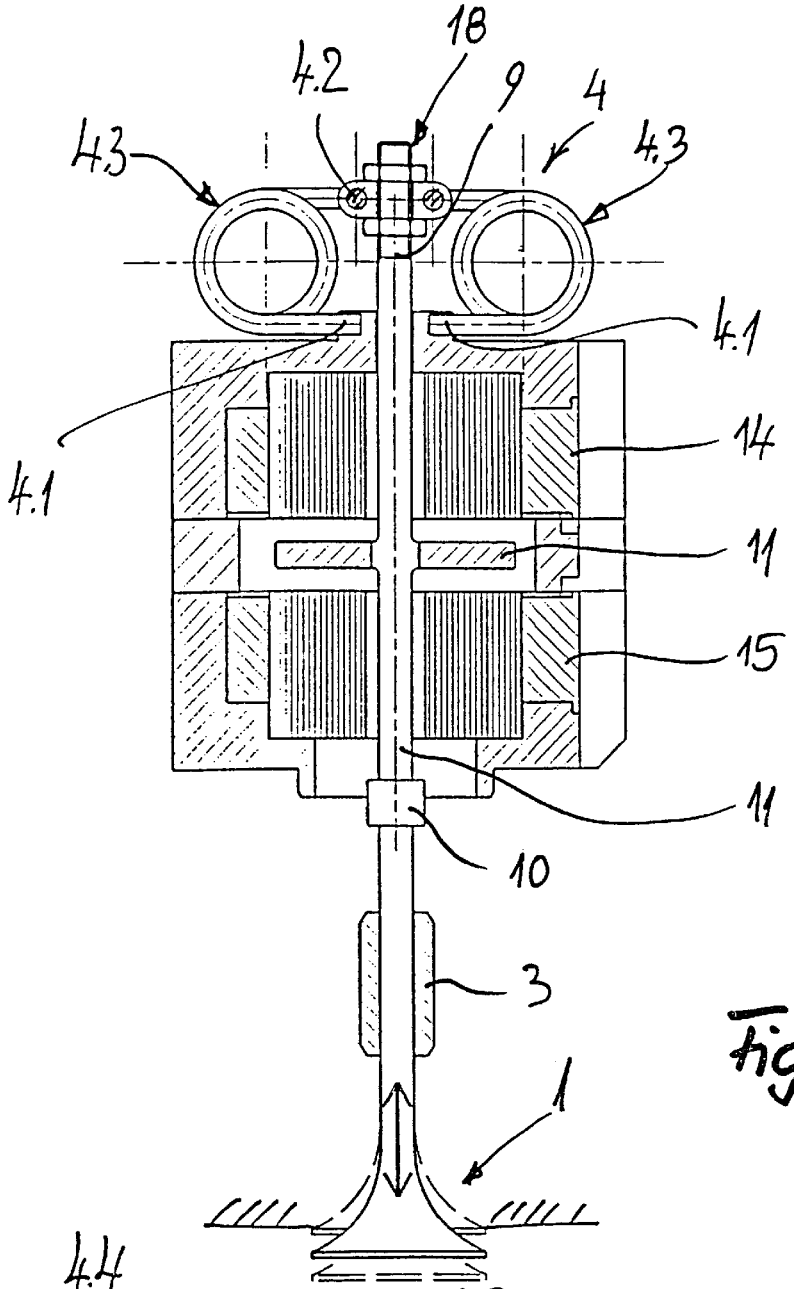
FIG. 5 is an axial elevational view, partially in section, of another preferred embodiment including two oppositely wound rotary springs.
Figure 6:
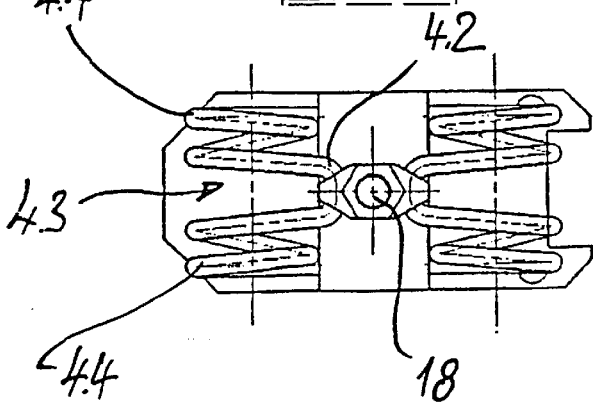
FIG. 6 is a top plan view of the construction shown in FIG. 5.

FIGS. 5 and 6 illustrate an embodiment in which the spring unit 4 is formed by two rotary spring elements 4.3. Each spring element 4.3 is composed of two oppositely wound coil spring halves 4.4 each having opposite terminal legs 4.1 attached to the housing 20. In the transitional region between the two spring halves 4.4 where the winding direction changes, a terminal leg 4.2 is formed which is connected by a respective clamping element with the free end 9 of the driving component 11. The connection between the two rotary spring elements 4.3 and the driving component 11 is so designed that by means of respective nuts of the adjusting mechanism 18 the earlier described mid position of the armature 12 may be set.

Figure 7:
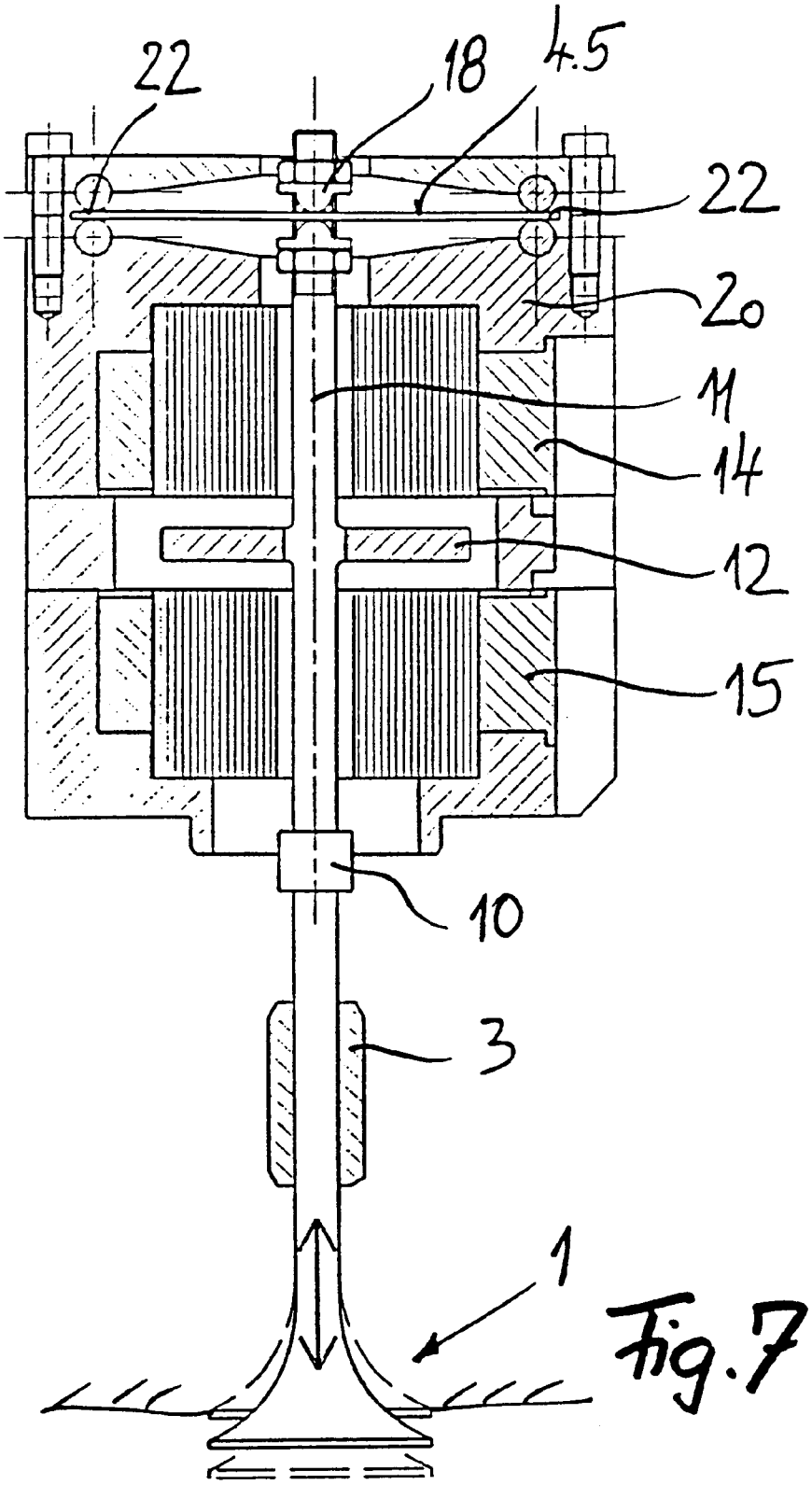
FIG. 7 is an axial elevational view, partially in section, of yet another preferred embodiment including a leaf spring connected with the driving component of the electromagnetic actuator.

FIG. 7 shows an embodiment in which the spring unit 4.5 is constituted by a leaf spring which may be a bar or a flexible diaphragm and which, in the shown embodiment, is at its edges firmly attached to the housing 20 by a clamping arrangement 22. In its mid zone the spring unit 4.5 is connected with the driving component 11; in this embodiment too, by means of nuts of an adjusting mechanism 18 the mid position of the armature 12 may be set.

It will be understood that the above description of the present invention is susceptible to various modifications, changes and adaptations, and the same are intended to be comprehended within the meaning and range of equivalents of the appended claims.

What is claimed is:

1. An electromagnetic actuator in combination with a driven component, comprising (a) first and second electromagnets having respective first and second pole faces oriented toward one another and defining a space therebetween;

(b) an armature disposed in said space and movable back and forth between said first and second pole faces in a direction of motion;

(c) a driving component attached to said armature for moving therewith as a unitary structure;

(d) an adjusting mechanism for setting a mid position of said armature between said first and second pole faces;

(e) a spring unit attached solely to one of said driving component and said driven component and exerting forces opposing movements of said armature caused by electromagnetic forces generated by said electromagnets; said spring unit being in a relaxed state when said armature is in said mid position and being in an armed state upon movement of said armature in either direction from the mid position; and (f) means for connecting said driving component with said driven component for effecting a transmission of moving forces from said driving component to said driven component to cause displacements of said driven component as a function of displacements of said armature and said driving component.

2. The electromagnetic actuator as defined in claim 1, wherein said spring unit, said adjusting mechanism and said driving component are connected in series.

3. The electromagnetic actuator as defined in claim 2, wherein said spring unit is situated between said adjusting mechanism and said driving component.

4. The electromagnetic actuator as defined in claim 2, wherein said adjusting mechanism is situated between said spring unit and said driving component.

5. The electromagnetic actuator as defined in claim 1, wherein said spring unit comprises a coil spring.

6. The electromagnetic actuator as defined in claim 1, further comprising an actuator housing accommodating said spring unit; said spring unit having a first end connected to said housing and a second end connected to said driving component.

7. The electromagnetic actuator as defined in claim 1, wherein said spring unit comprises a sole coil spring coaxially surrounding said driven component.

8. The electromagnetic actuator as defined in claim 1, wherein said spring unit comprises a sole coil spring adjoining said driving component in axial alignment therewith; said sole coil spring being situated externally of said driven component.

9. The electromagnetic actuator as defined in claim 1, wherein said spring unit comprises a coil spring having first and second ends; said first end being firmly affixed to said driving component; further comprising an actuator housing accommodating said coil spring; said second end of said coil spring being rotatably supported by said actuator housing.

10. The electromagnetic actuator as defined in claim 1, wherein said driving component has a longitudinal axis oriented parallel to said direction of motion, and said spring unit comprises two coil springs disposed side-by-side parallel to one another and to said longitudinal axis of said driving component; said coil springs being wound in opposite directions.

11. The electromagnetic actuator as defined in claim 1, wherein said spring unit comprises a flat bending spring.

12. The electromagnetic actuator as defined in claim 11, further comprising an actuator housing accommodating said bending spring; wherein said bending spring has an outer edge zone affixed to said housing and a central zone attached to said driving component.

13. The electromagnetic actuator as defined in claim 12, wherein said bending spring is a diaphragm.

14. An electromagnetic actuator in combination with a driven component, comprising (a) first and second electromagnets having respective first and second pole faces oriented toward one another and defining a space therebetween;

(b) an armature disposed in said space and movable back and forth between said first and second pole faces in a direction of motion;

(c) a driving component attached to said armature for moving therewith as a unitary structure;

(d) a spring unit attached solely to one of said driving and driven components and exerting forces opposing movements of said armature caused by electromagnetic forces generated by said electromagnets; said spring unit being in a relaxed state when said armature is in a mid position between said first and second pole faces and being in an armed state upon movement of said armature in either direction from the mid position; said spring unit comprising a rotary spring element composed of two consecutive, oppositely wound coil spring halves; said rotary spring element having an end and a leg;

(e) means for connecting said driving component with said driven component for effecting a transmission of moving forces from said driving component to said driven component to cause displacements of said driven component as a function of displacements of said armature and said driving component; and (f) an actuator housing accommodating said spring unit; said end of said rotary spring element being attached to said housing and said leg of said rotary spring element being attached to said driving component.

15. The electromagnetic actuator as defined in claim 14, wherein said driving component has a longitudinal axis oriented parallel to said direction of motion and said coil spring halves have aligned axes constituting a rotary spring element axis oriented perpendicularly to said longitudinal axis of said driving component.

16. An electromagnetic actuator in combination with a driven component, comprising (a) first and second electromagnets having respective first and second pole faces oriented toward one another and defining a space therebetween;

(b) an armature disposed in said space and movable back and forth between said first and second pole faces in a direction of motion;

(c) a driving component attached to said armature for moving therewith as a unitary structure;

(d) a spring unit attached solely to one of said driving and driven components and exerting forces opposing movements of said armature caused by electromagnetic forces generated by said electromagnets; said spring unit being in a relaxed state when said armature is in a mid position between said first and second pole faces and being in an armed state upon movement of said armature in either direction from the mid position; said spring unit comprising two rotary spring elements composed of two consecutive, oppositely wound coil spring halves; said rotary spring elements each having an end and a leg; said leg being attached to said driving component; said rotary spring elements being oriented parallel to one another and being situated on either side of said driving component;

(e) means for connecting said driving component with said driven component for effecting a transmission of moving forces from said driving component to said driven component to cause displacements of said driven component as a function of displacements of said armature and said driving component; and (f) an actuator housing accommodating said spring unit; said end of said rotary spring elements being attached to said housing.

17. The electromagnetic actuator as defined in claim 16, wherein said driving component has a longitudinal axis oriented parallel to said direction of motion and said rotary spring elements each have a spring axis oriented perpendicularly to said longitudinal axis.

* * * * *